US005762417A

United States Patent [19]

Essen et al.

[11] Patent Number: 5,762,417

[45] Date of Patent: Jun. 9, 1998

[54] HIGH SOLIDITY COUNTERFLOW IMPELLER SYSTEM

[75] Inventors: John Von Essen, Palmyra; Wojciech Wyczalkowski, Harrisburg, both of Pa.

[73] Assignee: Philadelphia Mixers, Palmyra, Pa.

[21] Appl. No.: 797,843

[22] Filed: Feb. 10, 1997

[51] Int. Cl.[6] ..... B01F 5/12

[52] U.S. Cl. ..... 366/264; 366/270; 366/329.1; 366/330.1; 366/307; 416/231 A

[58] Field of Search ..... 416/231 A; 415/62, 415/77, 79; 366/270, 264, 327.1, 329.1, 330.1, 307

[56] References Cited

U.S. PATENT DOCUMENTS

| | | | |
|---|---|---|---|
| 988,167 | 3/1911 | Brannen | 366/270 |
| 3,092,678 | 6/1963 | Braun | 366/270 |
| 3,378,236 | 4/1968 | Kasai | 366/270 |
| 3,635,589 | 1/1972 | Kristiansen | 415/79 |
| 5,326,226 | 7/1994 | Wyczalkowski et al. | 416/243 |

FOREIGN PATENT DOCUMENTS

| | | | |
|---|---|---|---|
| 1035848 | 8/1958 | Germany | 416/5 |

*Primary Examiner*—John T. Kwon

*Attorney, Agent, or Firm*—Eckert Seamans Cherin & Mellott

[57] ABSTRACT

A mixing apparatus has a tank for holding a material to be mixed, a drive shaft rotatable in the tank, a radially inner impeller on the drive shaft with blades pitched to produce axial flow of the material in a first direction, and a radially outer impeller with blades pitched to produce axial flow in an opposite direction. The radially inner impeller can be a high solidity impeller disposed in a preferably-stationary flow shield occupying a portion of a circumference between the inner and outer impellers, and providing a barrier between the material flowing axially in opposite directions while leaving spaces for recirculation of material by radial flow at the ends of the opposite axial flows. The outer impeller can be coupled to the drive shaft by connecting members protruding radially through axial spaces provided in or around the flow shield. Baffles are fixed in the tank and support the flow shield. The baffles have inclined inner and outer sections that extend axially and are pitched to intercept circumferential flow produced by the inner and outer impellers, respectively, redirecting the flow axially in the appropriate direction. A number of axially spaced impeller stages are provided, each having an inner impeller in a section of the flow shield and an outer impeller on connecting members that extend through axial gaps between sections of flow tube supported on the baffles.

13 Claims, 2 Drawing Sheets

HIGH SOLIDITY COUNTERFLOW IMPELLER SYSTEM

BACKGROUND OF THE INVENTION

1. Field of the Invention

The invention relates to the field of rotational mixing apparatus, and in particular concerns an impeller system employing high solidity radially inner impeller blades for pumping in one axial direction, coupled to radially outer impeller blades for pumping in an opposite axial direction, and with fixed baffles and flow shields that provide distinct inner and outer axial flow paths.

2. Prior Art

A high solidity impeller structure is disclosed in U.S. Pat. No. 5,326,226—Wyczalkowski et al., which is hereby incorporated in its entirety. The impeller has a plurality of blades mounted on a rotational drive shaft to provide an axial flow with rotation of the impeller. Such blades are generally known as hydrofoil impeller blades, and are useful for mixing and aerating operations, in particular producing a circulating axially downward flow along the center line of a tank, with an axially upward flow around the periphery. Gas may be sparged into the tank, e.g., below the impeller, where the gas bubbles rise against the axially downward flow.

An object of impeller blade design is to obtain the greatest efficiency of fluid movement, namely to maximize the volume of fluid moved per unit of power expended to rotate the impeller. Another object of impeller design is to reduce the cost of manufacture without adversely affecting the efficiency of the impeller or the attributes of the impeller for use in its particular mixing application. In the Wyczalkowski et al. patent, these objects are addressed by providing blades formed of plate stock, rolled along the axis of a cylinder such that the roll axis lags the radius at which the blades are attached to the drive shaft, for example by 45°. The blades thus approximate the shape of a hydrofoil, although they are made of rolled plate stock rather than being cast.

The Wyczalkowski blades are dimensioned to form a "high solidity" impeller, namely an impeller in which the plurality of blades when viewed along the rotation axis, occupy a high proportion of the area of axial projection of the impeller, preferably about 90% of the area. High solidity impellers are particularly useful in sparging applications wherein a rising column of gas bubbles is opposed by an axial downward flow of liquid, because the impellers reduce the tendency of the rising gas to produce an upward flow leading to flooding, foaming or splashing.

The required configuration of an impeller blade is complicated by the fact that the radially outer portion has a greater linear speed than the radially inner portion. The inner portion must be pitched more steeply than the outer portion to equalize the axial flow rates at different radii. The pitch of the impeller produces a resultant force component causing liquid to rotate with the impeller. In a high solidity blade configuration, the blades are relatively wide and paddle-like, such that the rotational displacement of the liquid can be substantial. Resulting centripetal acceleration causes a radially outward liquid flow component. Finally, eddy currents and turbulence occur adjacent to the edges of the impeller blades.

High viscosity mixing applications can benefit particularly if axial flow is improved. As viscosity increases there is a tendency for the liquid to rotate locally with the impeller. In order to achieve overall fluid motion in high viscosity mixing applications (e.g., over about 50,000 centipoise), it is sometimes necessary to provide a large diameter anchor agitator or a helical ribbon agitator that moves the fluid in the manner of an auger. Such "large" diameter agitating structures extend, for example, to 90% of the vessel diameter, and are relatively expensive. Insofar as the chosen structure of the rotating impeller is axially continuous, the impeller structure may preclude the possibility of placing fixed baffles between axially spaced impeller blades or sections, to better guide the flow in an axial direction as opposed to rotating the fluid. The absence of baffles also can make the mixing apparatus less than suitable for lower viscosity mixing applications (e.g., below about 20,000 centipoise).

It would be advantageous to optimize a mixing system for high solidity impellers and thereby to improve on the efficiency of fluid flow volume per unit of expended power. It would further be advantageous if this could be accomplished in a mixing apparatus that is efficient over a wide range of viscosities. It is an aspect of the invention that certain rotating counterflow impeller structures are employed with a high solidity impeller for mixing applications having radially inner and outer flow, together with fixed inclined baffles and flow shields, which work together with a high solidity impeller as in Wyczalkowski, for maximizing axial flow in both opposite directions with rotation of the impeller and over a wide range of viscosities.

SUMMARY OF THE INVENTION

It is an object of the invention to optimize the operation of a high solidity impeller for mixing applications over a range of viscosities, involving radially inner and outer axial flow in opposite directions.

It is another object to couple sets of impeller blades structured for forcing a liquid in opposite directions, to a common drive shaft.

It is a further object to intercept inefficient circumferential and radial flows produced by an impeller blade and to direct such flows axially.

It is also an object to provide a structure to isolate radially inner and outer flow paths in a mixing apparatus as described, with connecting structures for impeller blades in the radially outer flowpath extending through the isolating structure, and such that the isolating structure does not impede recirculation of fluid to flow from one opposite axial path into the other, e.g., at the surface of whatever level of fluid is in the tank.

It is another object to mount a partial flow shield separating radially inner and outer zones via baffles pitched to redirect circumferential flow axially.

It is another object to optimize the impeller blades of a mixing apparatus such that the outer blades, which move linearly faster than the inner blades, can provide a substantial driving force while the inner blades efficiently return liquid in a circulating path.

These and other objects are accomplished by a mixing apparatus including a tank for holding a material to be mixed, a drive shaft rotatably supported in the tank, a radially inner impeller on the drive shaft with blades pitched to produce axial flow of the material in a first direction (especially downwardly), and a radially outer impeller on the drive shaft with blades pitched to produce axial flow in an opposite direction (upwardly). The radially inner impeller can be a high solidity impeller disposed in a flow shield between the inner and outer impellers, providing a barrier between the material flowing axially in said first and second directions. The outer impeller is coupled to the drive shaft by connecting members protruding radially through axial spaces provided in or around the flow shield, which extends only partially around a full circumference to leave spaces permitting fluid to recirculate from one axial direction to the other at the end of the axial path, regardless of the surface level of the fluid as compared to the position of the flow shield. Baffles are fixed in the tank and preferably the flow shield is fixed to the tank by the baffles. The baffles have inclined inner and outer sections that extend axially and are pitched to intercept circumferential flow produced by the inner and outer impellers, respectively, and to redirect the flow axially in the appropriate direction of flow. The apparatus can include a number of axially spaced impeller stages, each having an inner impeller encompassed by a section of flow shield and an outer impeller on connecting members that extend through axial gaps between the flow shield sections or stages.

BRIEF DESCRIPTION OF THE DRAWING

Shown in the drawing is an exemplary embodiment of the invention as presently preferred. It should be understood that the invention is not limited to the embodiment disclosed as an example, and is capable of variation within the scope of the appended claims. In the drawings.

DETAILED DESCRIPTION OF THE PREFERRED EMBODIMENTS

Figure 1:
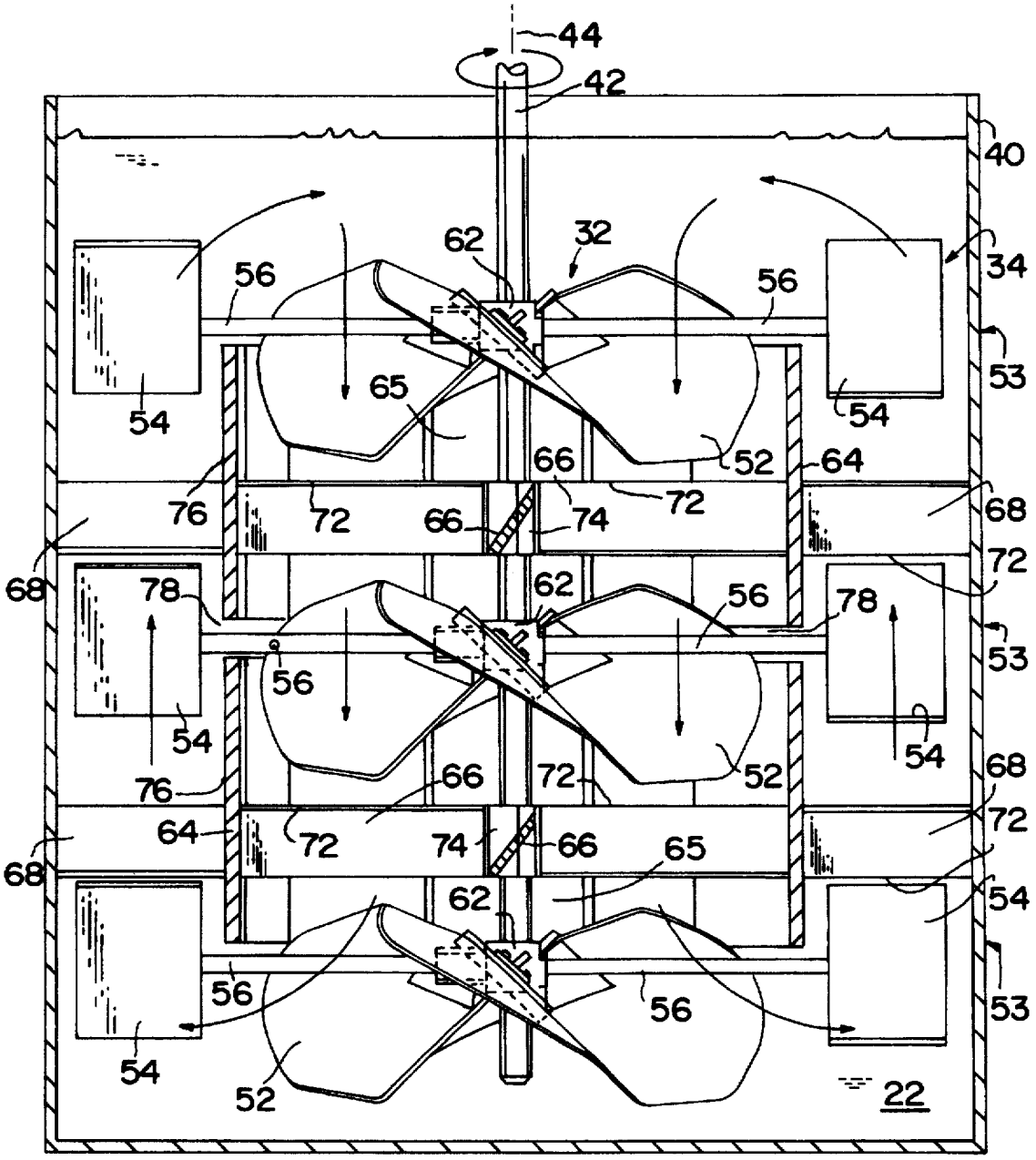
FIG. 1 is a sectional view of a mixing apparatus according to the invention.

As shown in FIG. 1, a mixing apparatus 22 is provided with flow guiding and confining structures that cooperate with oppositely pitched inner and outer impellers 32, 34 in order to maximize mixing efficiency. In particular, liquid moved by the rotating impellers 32, 34 is caused to move substantially axially in opposite directions at radially inner and outer areas of a tank 40 holding a material to be mixed.

A drive shaft 42 is supported for rotation in tank 40 on a rotation axis 44, and is coupleable to a gear motor (not shown) or similar powered device for rotating the drive shaft. A radially inner impeller structure 32 is fixed to drive shaft 42, and has at least two inner blades 52 pitched to produce axial flow of the material in a first direction with rotation of drive shaft 42 in the direction shown. The inner impeller 32, which preferably comprises a number of axially spaced stages 53, drives the material downwardly in the embodiment shown in FIG. 1, as indicated by arrows.

A radially outer impeller structure 34 is also fixed to drive shaft 42, and has at least two outer blades 54 pitched to produce axial flow of the material in a second direction with rotation of drive shaft 42, namely upwardly in FIG. 1. Thus the material circulates in tank 40 with rotation of drive shaft 42 and the impeller blades 52, 54 thereon.

Figure 2:
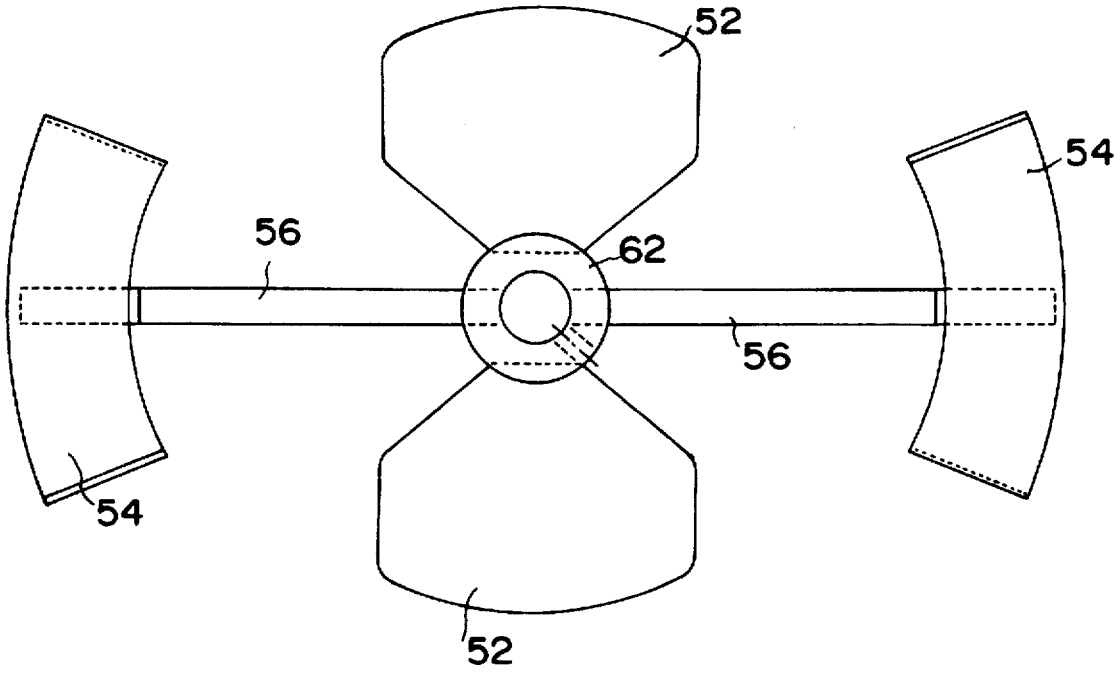
FIG. 2 is a plan view showing paired inner and outer impeller blades on a hub; and, FIG. 3 is an elevation view showing the impeller blades from the right in FIG. 2.
Figure 3:
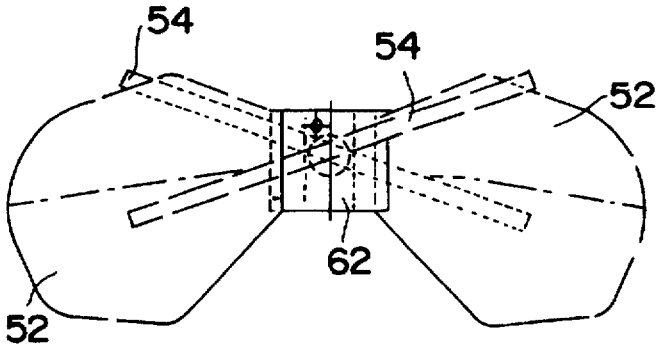

The radially inner impeller structure 32 preferably comprises a high solidity type impeller blade, for example as disclosed in U.S. Pat. No. 5,326,226—Wyczalkowski et al., which is hereby incorporated. In the preferred arrangement as shown in FIGS. 2 and 3, two inner blades 52 and two outer blades 54 are provided at 90° intervals. The outer blades can comprise flat plates as in FIGS. 2 and 3, pitched for example at about 20°, or can be curved (concave up) or pitched at a different angle. Whereas the outer blades are at a greater radius than the inner blades, they move linearly faster and provide good pumping efficiency driving the liquid upwardly in an annular space at the walls of the tank. The inner blades drive the liquid downwardly, returning the liquid in a circulating path.

The inner impeller blades 52 are formed of plate stock, rolled along the axis of a cylinder such that the roll axis lags the radius at which the blades are attached to drive shaft 42, for example by 45°. The blades 52 thus approximate the shape of a hydrofoil. The radially outer impeller structure 34 comprises blades 54 with flat plates, curved as shown in plan in FIG. 2 to fit in the available annular space, and inclined relative to rotation axis 44. The outer blades are carried on connecting members 56 extending to the central hub 62 to which inner impeller blades 52 are also attached.

The tendency of the radially inner and outer opposite axial flows of liquid to interfere turbulently with one another is minimized by a flow shield 64 in tank 40, disposed substantially between the inner and outer impeller structures 32, 34, and providing a barrier that tends to isolate the flows of material in the first and second axial directions. Flow shield 64 is substantially tubular and extends for an axial length encompassing the inner impeller structure 32 while providing gaps or spaces for clearance for the connecting members 56 carrying outer blades 34 (i.e., axial gaps). Flow shield 64 is radially closely adjacent to inner impeller 32 and confines radially outward flow from the inner impeller which would otherwise occur due to centripetal acceleration as impeller 32 is rotated by drive shaft 42. The connecting members 56 for outer impeller blades 54 protrude radially through or around flow shield 64. Flow shield 64 preferably is rigidly fixed relative to tank 40.

The flow shield preferably extends less than 360° around the axis, thus leaving gaps 65 of a certain circumferential or angular width between segments of the flow shield (i.e., longitudinal gaps). The flow shield is thereby structured to permit liquid to flow in a radial direction through the longitudinal gaps, particularly at one or both ends of the opposite axial paths where the liquid changes direction in the recirculating path shown. Assuming that the depth of liquid in the tank may vary, providing the longitudinal gaps permits the liquid to reverse direction without necessarily passing around an axial end of a section of the flow shield, which otherwise could impede recirculation when the tank is not full. Preferably, flow shield 64 extends circumferentially about 180°, namely in two 90° sections attached to a baffle structure at opposite sides. However, flow shield 64 can also extend around a larger or smaller proportion of the circumference.

According to an inventive aspect, mixing apparatus 22 further comprises at least one and preferably a plurality of baffles 66, 68, fixed in tank 40. Each of the baffles 66, 68 is axially adjacent to an impeller 32, 34 disposed upstream in the direction of flow. The baffles 66, 68 extend radially through an area of at least one of the inner and outer impeller structures 32, 34. The baffles 66, 68 are inclined relative to a circumferential path of the liquid, preferably by about 45°. Whereas the liquid is in part moved circumferentially by rotation of the associated impeller 32, 34, the inclined baffles 66, 68 convert the direction of flow from circumferential to substantially axial. Thus, considering the direction of rotation of impeller blades 52, 54, the baffles 66, 68 each have a leading edge directed toward the impeller blade 52, 54, which leading edge is ahead of the position of the trailing edge in the rotation direction. In other words, baffles 66, 68 and their associated impeller blades 52, 54 are inclined or pitched in opposite directions from one another. The baffles 66, 68 are rigidly mounted in tank 40, for example by welding. Baffles 66, 68 are also attached to flow shield 64 and thereby rigidly support the flow shield sections in tank 40.

In the embodiment of FIG. 1, three impeller stages 53 are provided; however any number is possible. Each stage 53 has inner and outer impeller structures 32, 34 fixed to drive shaft 42. The impeller stages 53 are spaced axially along drive shaft 42, and the baffles 66, 68 are disposed between impeller stages 53. The inner baffles 66 can have journal couplings 74 that rotatably support drive shaft 42 between impeller stages 53, permitting a long length of drive shaft 42 with many impeller stages 53 but without the tendency to wobble the drive shaft.

Flow shield 64 likewise has axially spaced stages or sections 76. Tank 40 is preferably tubular and the sections of flow shield 64 are correspondingly tubular but preferably have longitudinal gaps 65, as discussed. The flow shield stages 76 form barriers that isolate the radially inner and outer opposite axial flows, each stage 76 extending for an axial length encompassing a respective stage 53 of the impeller structures 32, 34. Axial gaps 78 are provided between the sections of flow shield stages 76, through which the connecting members 56 for outer impeller blades 54 protrude radially. The outer impeller blades 54 can be welded to the connecting members 56, and the connecting members can be welded to the hubs 62.

In the embodiment shown in FIG. 1, two inner impeller blades 52 and two outer impeller blades 54 are shown with four baffles 66, 68 for each bank (or eight, counting the inner and outer baffles separately). It is possible to use any number of blades 52 54, baffles 66, 68 and/or flow shield sections for the inner and outer impellers. The depicted embodiment has the respective banks of impeller blades, baffles and flow shield sections mounted angularly in registry. These banks can be angularly offset as well.

The size of the inner and outer impeller blades is chosen to achieve substantially equal fluid movement capacity for maximum efficiency. The linear speed of outer impeller blades 54, at 90 to 95% of the tank diameter, is substantially greater than that of inner blades 52, which preferably encompass about 60% of the tank diameter. The faster moving outer blades provide good pumping efficiency due to the large diameter. To equalize the pumping rate of the inner and outer blades, the outer blades 54 can be smaller in area than inner blades 52, less numerous and/or less steeply pitched than inner blades 52. The particular size of the blades 52, 54 and the speed at which they are rotated, can be varied as known in the art to reflect the characteristics of the fluid being mixed. However, the disclosed embodiment has been found to be efficient over a range of mixing conditions and power levels. In addition, the mixing structure is efficient over a wide range of liquid viscosities.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. A mixing apparatus comprising:

a tank for holding a material to be mixed;

a drive shaft supported for rotation in the tank on a rotation axis;

a radially inner impeller structure fixed to the drive shaft, having at least two inner blades pitched to produce axial flow of the material in a first direction with rotation of the drive shaft;

a radially outer impeller structure fixed to the drive shaft, having at least two outer blades pitched to produce axial flow of the material in a second direction with said rotation of the drive shaft; and, a flow shield in the tank, disposed substantially between the inner and outer impeller structures, the flow shield providing a barrier between the material flowing axially in said first and second directions, and wherein the outer impeller structure is coupled to the drive shaft by connecting members protruding radially through the flow shield.

2. The mixing apparatus of claim 1, wherein the radially inner impeller structure comprises a high solidity impeller wherein the inner blades occupy at least 40% of an area in a circle in which the inner impeller structure rotates.

3. The mixing apparatus of claim 1, wherein the flow shield is substantially circular in section and extends for an axial length encompassing the inner impeller structure.

4. The mixing apparatus of claim 3, wherein the flow shield comprises sections spaced by angular gaps extending longitudinally.

5. The mixing apparatus of claim 4, wherein the sections of the flow shield encompass about 180° of circumference.

6. The mixing apparatus of claim 1, wherein the flow shield is rigidly fixed relative to the tank.

7. The mixing apparatus of claim 6, further comprising at least one baffle fixed in the tank, the baffle being axially adjacent and extending radially through an area of at least one of the inner and outer impeller structures, the baffle being inclined relative to a circumferential path of material urged partly circumferentially by rotation of said at least one of the inner and outer impeller structures, such that said material is directed substantially axially, and wherein the flow shield is attached to the baffle and thereby rigidly supported in the tank.

8. The mixing apparatus of claim 1, further comprising at least one baffle fixed in the tank, the baffle being axially adjacent and extending radially through an area of at least one of the inner and outer impeller structures, the baffle being inclined relative to a circumferential path of material urged partly circumferentially by rotation of said at least one of the inner and outer impeller structures, such that said material is directed substantially axially.

9. A mixing apparatus comprising:

a tank for holding a material to be mixed;

a drive shaft supported for rotation in the tank on a rotation axis;

a radially inner impeller structure fixed to the drive shaft, having at least two inner blades pitched to produce axial flow of the material in a first direction with rotation of the drive shaft;

a radially outer impeller structure fixed to the drive shaft, having at least two outer blades pitched to produce axial flow of the material in a second direction with said rotation of the drive shaft; and, wherein the mixing apparatus includes a plurality of impeller stages, each comprising one said inner and one said outer impeller structure, the impeller stages being spaced axially along the drive shaft, further comprising baffles disposed between the impeller stages with radially inner portions of the baffles being pitched to direct circumferential flow from the inner impeller structures axially in said first direction and radially outer portions of the baffles being pitched to direct circumferential flow from the outer impeller structures axially in said second direction.

10. The mixing apparatus of claim 9, further comprising a substantially tubular flow shield in the tank, having flow shield stages disposed substantially between the inner and outer impeller structures, said flow shield stages extending for an axial length encompassing respective stages of the inner impeller structure, the flow shield stages providing barriers between the material flowing axially in said first and second directions.

11. The mixing apparatus of claim 10, wherein the stages of the outer impeller structure are coupled to the drive shaft by connecting members protruding radially through axial spaces between sections of the flow shield.

12. The mixing apparatus of claim 11, wherein the flow shield is rigidly fixed relative to the tank.

13. The mixing apparatus of claim 12, wherein the baffles are rigidly coupled to the tank between the inner and outer impeller structures of said respective stages, and the flow shield stages are rigidly fixed on the baffles.

* * * * *